US007757503B2

(12) United States Patent
Taylor

(10) Patent No.: US 7,757,503 B2
(45) Date of Patent: Jul. 20, 2010

(54) GAS PRESSURE REDUCER, AND AN ENERGY GENERATION AND MANAGEMENT SYSTEM INCLUDING A GAS PRESSURE REDUCER

(75) Inventor: Anthony John Taylor, Bristol (GB)

(73) Assignee: 20C, Bath & Northeast Somerset (GB)

( * ) Notice: Subject to any disclaimer, the term of this patent is extended or adjusted under 35 U.S.C. 154(b) by 515 days.

(21) Appl. No.: 11/754,342

(22) Filed: May 28, 2007

(65) Prior Publication Data

US 2007/0283705 A1 Dec. 13, 2007

(30) Foreign Application Priority Data

Jun. 7, 2006 (GB) ..... 0611245.2
Dec. 22, 2006 (GB) ..... 0625849.5

(51) Int. Cl.
*F25B 27/00* (2006.01)
*F25D 9/00* (2006.01)

(52) U.S. Cl. ..... 62/172; 62/323.1; 62/401; 60/614; 60/649; 290/1 A

(58) Field of Classification Search ..... 60/614, 60/616, 649; 62/172, 401–402, 323.1; 290/1 A
See application file for complete search history.

(56) References Cited

U.S. PATENT DOCUMENTS 3,868,827 A * 3/1975 Linhardt et al. ..... 62/63
3,992,891 A * 11/1976 Pocrnja ..... 62/50.3
4,353,214 A * 10/1982 Gardner ..... 60/652
5,806,316 A * 9/1998 Avakov et al. ..... 60/649
6,381,973 B1 * 5/2002 Bhatti et al. ..... 62/172
7,040,112 B2 * 5/2006 Axe et al. ..... 62/401
7,347,049 B2 * 3/2008 Rajendran et al. ..... 60/649
2003/0029177 A1 * 2/2003 Clarke ..... 62/172

OTHER PUBLICATIONS

Third party observation filed by Caddet Energy Efficiency at the EPO on Apr. 25, 2008 entitled Town Gas Pressure for Electricity and Chilled Water Cogeneration System.
Third party observation filed by John Baldwin at the EPO on Apr. 25, 2008 regarding Patent Application EP 1865249.

* cited by examiner

*Primary Examiner*—William E Tapolcai
(74) *Attorney, Agent, or Firm*—Reising Ethington P.C.

(57) ABSTRACT

A gas pressure reducer comprising at least one gas expansion device for allowing the gas to expand and thereby reduce in pressure, and at least one means for raising the temperature of the gas in the vicinity of the gas expansion device and wherein the means for raising the temperature of the gas comprises a liquid or solid fuel heater or a liquid fuelled engine.

15 Claims, 2 Drawing Sheets

Figure 1:
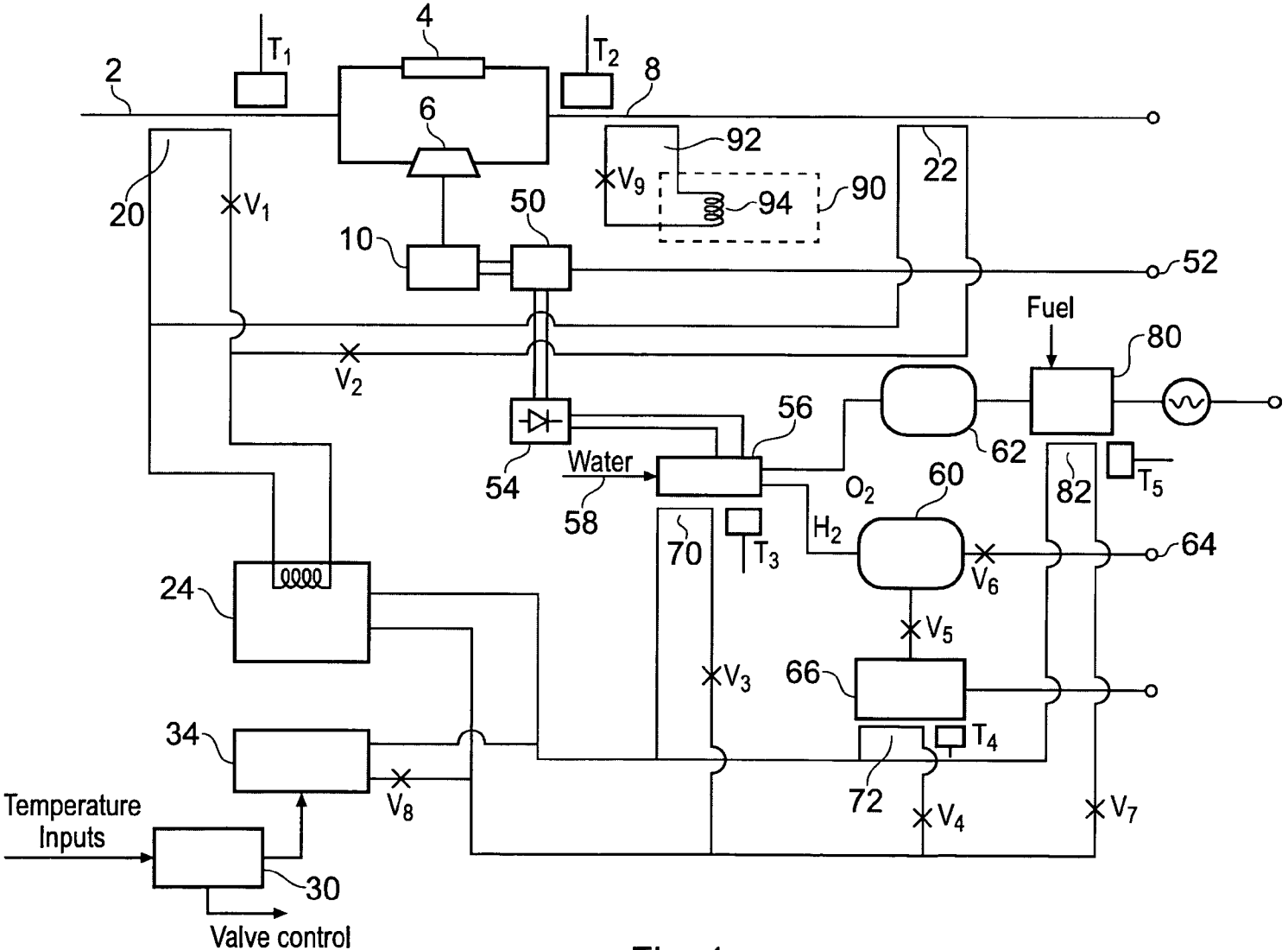

GAS PRESSURE REDUCER, AND AN ENERGY GENERATION AND MANAGEMENT SYSTEM INCLUDING A GAS PRESSURE REDUCER

FIELD OF THE INVENTION

The present invention relates to an apparatus for reducing the gas pressure in a gas distribution system.

BACKGROUND OF THE INVENTION

Natural gas is commonly used as a fuel. The gas is generally under considerable pressure when it is extracted from the gas reservoir and this pressure is maintained in a high pressure core of a gas transmission and distribution system. The gas pressure within the transmission system (at least in the UK) is typically in the region of 72 bar. Gas at this pressure is unsuitable for distribution to consumers due to the potential safety hazards of working at this pressure and consequently the transmission and distribution system reduces the pressure typically in a first stage from 72 bar to an intermediate pressure of around 32 bar and subsequently to less than 1 bar compared to atmospheric pressure at the delivery point. Thus the transmission and distribution systems can be regarded as having a high pressure portion operating at around 72 bar, a medium pressure portion operating at around 32 bar, and a low pressure portion operating between 7 bar and eventually at around 1 bar. At the transition from one portion to another portion the gas pressure needs to be reduced and this is performed by a series of pressure reducing valves at pressure reduction stations. Other (but similar) pressure schemes within a distribution network are known.

The expanding gas changes volume, and as it does so it performs mechanical work. The gas expansion process is essentially adiabatic and consequently the energy for the mechanical work done by the expanding gas is removed from the thermal energy carried by the gas and consequently the gas cools as it expands. The cooling of the gas may result in the formation of ice and/or complex hydrates in and around the gas carrying pipes which can damage control valves within the gas distribution system and cause freezing of the ground around the pipe which in turn may cause a permafrost zone to be created which could give rise to distortion or ground heave around the pipe.

SUMMARY OF THE INVENTION

According to a first aspect of the present invention there is provided a gas pressure reducer comprising at least one gas expansion device for allowing the gas to expand and thereby reduce in pressure, and at least one means for raising the temperature of the gas in the vicinity of the gas expansion device and wherein the means for raising the temperature of the gas comprises a liquid or solid fuelled heater or a liquid fuelled engine.

It is thus possible to warm the gas so as to increase the temperature of the gas in the vicinity of the gas expander to a point where the expanded gas temperature remains above a threshold temperature. Preferably the threshold temperature is selected so as to inhibit the formation of one or both of ice and complex hydrates at least within portions of the pipe that are below ground.

Preferably heat is added to the gas flow upstream of the expander so as to prevent gas on the downstream side of the expander becoming sufficiently cold to cause the formation of undesirable liquids or solids within the gas pipe or the environment surrounding the gas pipe. Heat may be introduced into the gas by way of a heat exchanger. A further heat exchanger or further heat exchangers may be added downstream of the gas expander in order to ensure that the gas leaving the gas pressure reducer has a minimum desired temperature.

Hitherto it has been known to tap into the gas supply itself so as to provide a source of fuel for a heater or a gas powered internal combustion engine. This removes the need to transport fuel to the engine or heater by another delivery method.

However, the inventor has realised that use of gas as a fuel has several disadvantages.

Firstly the gas is at high pressure, so pressure reduction steps have to be taken to reduce the pressure to be suitably low for use by the burner or internal combustion engine. This brings some difficulties in maintaining and servicing the engine or burner and those components which enable it to be isolated from the gas supply.

Secondly if the gas supply fails—for example because work has to be performed on the gas main—then there is no fuel to the heater or engine. This means when the supply is re-enabled there may be a period of time where pressure reduction is occurring at the pressure reducer but the supply of gas to the engine is either insufficient to enable operation of the engine and/or burner and hence the engine or burner is not able to be placed in an operational state prior to reinstatement of the supply.

However, the use of solid or liquid fuel has advantages in that a fuel store can be maintained on site such that the means for raising the gas temperature can be in an operative state independent of fluctuations in gas pressure or interruptions to the gas supply.

This is particularly advantageous where the pressure reduction station incorporates a generator driven by the expansion of the gas. In such circumstances the pressure reduction station can be used to supply electricity to other processes or enterprises which may rely on the integrity of the electricity supply. An internal combustion engine may be adapted to drive a generator such that some electrical power remains available whilst the engine is running even if the gas supply to the pressure reduction station has been interrupted. Heat from the engine can be used to warm the gas.

Preferably the fuel is a crop or vegetation derived fuel—which may be referred to as a bio-fuel.

By using bio-fuel, the heating process for the natural gas can be made "carbon neutral" at the pressure reducer. Thus crops can be planted in order to produce bio-fuel and in so doing the crops will capture and fix a certain amount of carbon extracted from carbon dioxide in the atmosphere. At the time of burning the fuel the carbon will be reconverted to carbon dioxide and, over a fuel generation and use cycle there will be no net change in the amount of carbon within the atmosphere. Therefore the fuel can be considered as being "carbon neutral" and sustainable.

Heat may also be provided to a downstream heat exchanger from the bio fuel heater, or engine.

It may be desirable to have further sources of heat for preventing the gas temperature from dropping. These sources may be provided as back up or emergency sources, or as second line sources for dealing with high gas flow rate transient conditions. Such sources may include burners of organic, but preferably inorganic fuels. An example of inorganic fuels is hydrogen peroxide which has a high calorific value in a small volume and reacts with air to produce heat and water or water vapour. The water vapour can be condensed to give up its latent heat which may then be supplied to warm the gas via a heat exchanger.

Additionally or alternatively heat may be provided to (or one may regard this as extracting cold from) a downstream heat exchanger from an ice-making plant, or other process that seeks to provide cold objects. The gas is generally "dry" so it is possible to allow the gas to become sufficiently cold for use in an ice making plant or cold store without resulting in the formation of restrictive residue within the gas distribution pipes.

The gas expander may be a controllable throttling orifice, such as a Joule-Thomson valve. Alternatively the gas pressure reducer may include a turbine expansion device, generally known as a turbo expander, which are commercially available from Cryostar SAS and other companies. The mechanical energy imparted to the turbine by the expansion of gas may usefully be used to drive an electricity generator.

The generator is advantageously associated with a power management controller such that the generator can deliver electricity to a local distribution system, to a national distribution system (such as the national grid) or to an energy storage system. Advantageously the energy storage system utilises the electrolysis of water to produce hydrogen and oxygen. The hydrogen may then be stored as a fuel for use at some other time. Alternatively other energy storage systems, such as pumped water systems, may be used to convert the electrical energy into potential energy by raising a mass against the force of gravity, such as pumping water into a reservoir, such that the potential energy can be converted into kinetic energy at a later time in order to generate electricity in a further turbine generator.

Advantageously heat exchangers are associated with the electrolysis station and any hydrogen fuel cells such that the heat from these devices may be extracted and used to supply heat to the gas in the vicinity of the gas expander.

Advantageously a controller is arranged to monitor the temperature and/or heat generation of the or each device as well as to monitor the incoming and exiting gas temperatures and to control the heater or engine, and/or the rate of heat extraction from other heat generating sources, in order to ensure that the gas temperature is maintained above a minimum threshold whilst also seeking to meet any other criteria or demands such as a request for electricity generation, placed on the system at any given time.

Advantageously the controller can modulate the amount of heat provided to the gas so as to control the temperature of the gas to fall within a target range. The controller may operate solely on feedback principles. However, the supply of gas around the distribution network is usually well controlled, and is often predictable. Many homes, for example, operate central heating systems on timers and consequently this gives rise to a predictable upsurge in consumption by domestic users in the morning. The operators of the distribution network can prepare for this increased flow or use. The fact that changes in mass flow through a pressure reduction station are predictable means that the controller for the station can include a predictive feed forward element such that the pressure reduction station increases its heat output in advance of the increased gas flow so as to be prepared for the increase in cooling that will accompany the increased gas flow. The feedback network can still be operative so as to inhibit excess heating in the even that the increase in mass flow is not as great as predicted.

Preferably the controller can control one or more heat sources, such as burners or internal combustion engines, to be operated such that the heat available from the heat sources is in excess of the heat required to warm the gas. The excess heat can be dumped or sent to a heat sink—which could be the atmosphere or could be further process capable of accepting varying amounts of heat, such as space heating (which could be used for buildings or green houses). Thus one or more flow control valves can be provided to control the relative delivery of heat to a heat exchanger for warming the gas and at least one heat exchanger for providing heat to a heat sinking process.

The combustion product from the heating means may be rich in carbon dioxide, and may be provided to greenhouses to encourage plant-growth.

According to a second aspect of the present invention there is provided a method of reducing pressure of a gas comprising operating a heat source to produce heat; supplying heat to the gas prior to the gas undergoing expansion; allowing the gas to expand; monitoring the temperature of the expanded gas and controlling the amount of heat supplied to the gas; wherein the heat source produces excess energy and the excess heat is directed towards a dump.

According to a third aspect of the present invention there is provided a gas pressure reduction station comprising: a heat source operable to produce heat in excess of that required to warm the gas so as to maintain a temperature of the gas leaving an expansion device at the pressure reduction station above a target temperature; a heat exchanger for delivering heat to a heat dump, heat sink or heat store; and a controller, wherein the controller monitors the temperature of the gas and controls the amount of heat delivered by the heat exchanger to the heat dump, heat sink or heat store so as to regulate the gas temperature.

BRIEF DESCRIPTION OF THE ACCOMPANYING DRAWINGS

Figure 2:
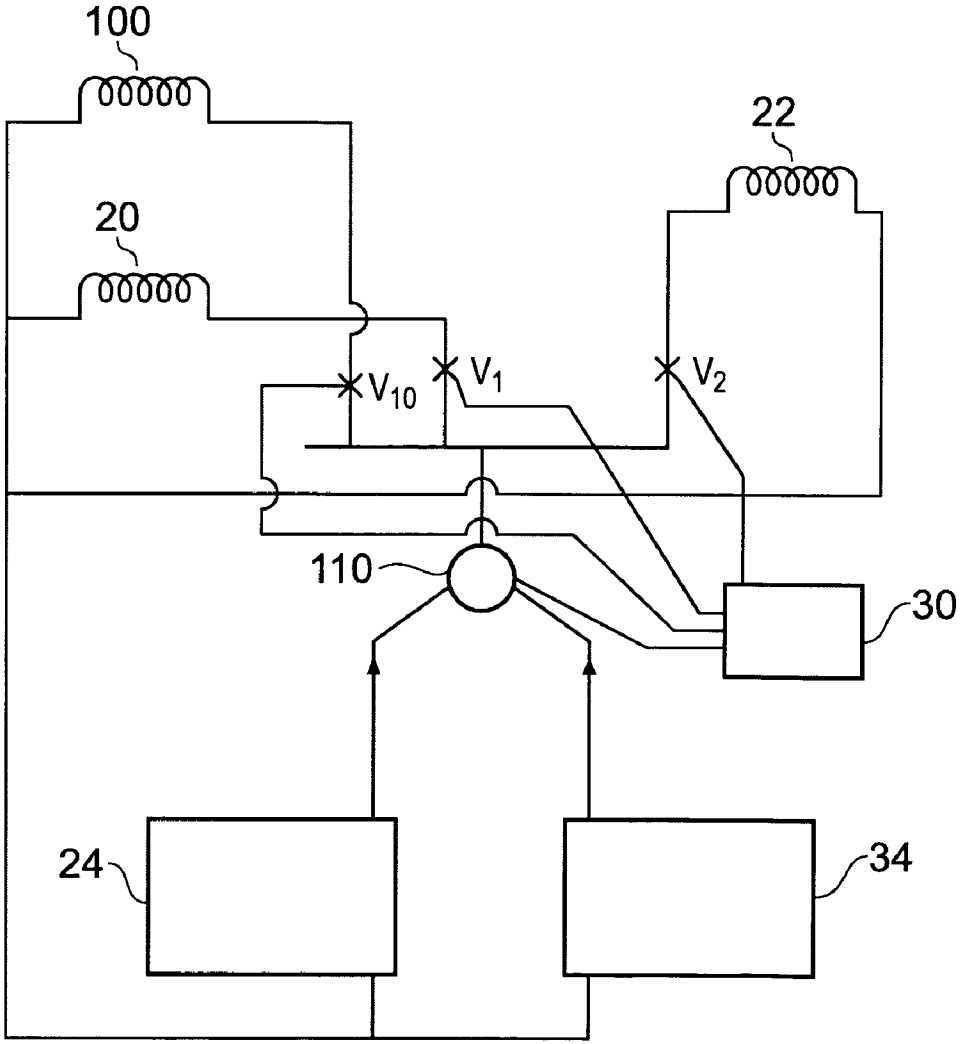

The present invention will further be described, with reference to the accompanying Figures, in which:

FIG. 1 schematically shows a gas pressure reducer constituting an embodiment of the present invention; and FIG. 2 shows a modification to the arrangement shown in FIG. 1.

DESCRIPTION OF PREFERRED EMBODIMENTS

FIG. 1 schematically illustrates a gas pressure reducer constituting an embodiment of the present invention. Gas at a first pressure is provided along a first gas main, generally designated 2, towards one or more gas expanders 4 and 6. Gas passing through either or both of the gas expanders 4 and 6 undergoes a pressure reduction and reduced pressure gas is output along a second gas pipe designated 8. In this example the gas expander 4 is a valve based gas expander, such as a Joule-Thomson valve, whereas the gas expander 6 is a turbo expander which is adapted to drive an electricity generator 10.

In use, the Thompson valve 4 or the turbo expander 6 can be controlled in a known manner to vary the gas flow or pressure through the pressure reducer in accordance with the demand on the gas distribution system at that time.

A heat exchanger 20 is provided in thermal contact with the gas in the supply pipe 2 so as to warm the gas prior to its entry to the gas expanders 4 and 6. Similarly a further heat exchanger 22 may be provided in thermal contact with the gas downstream of the expanders 4 and 6 so as to perform further heating of the gas if necessary. The heat exchangers 20 and 22 receive a warmed fluid from a central heat exchanger 24 which includes a pump (not shown) in order to ensure that a sufficient amount of fluid circulation occurs within each of the heat exchange paths. The fluid may be gas. Electrically or electro-pneumatically operated control valves V1 and V2 are operable under the control of a controller 30 so as to set the flow rates through the heat exchangers 20 and 22. The controller 30 also controls the rate of fuel utilisation by a diesel, a bio-diesel unit or a bio-fuel burner 34 which generates heat which is provided along an input path to the heat exchanger 24. Thus the fluid flow paths on the input side to the exchanger 24 and on the output side of the exchanger 24 never intermingle. Other heat exchanger topologies are permissible which may mix the flow paths. Fluid flow from the burner 34 can be regulated by control value V8. Additional backup heat exchangers corresponding to exchangers 20 and 22 and backup bio-fuel engines or burners corresponding to engine 34 can be provided in order to ensure redundancy at the gas expansion station.

In order to facilitate regulation of the gas temperature one or more gas temperature sensors designated T1 and T2 may provide inputs to the controller 30 such that it can control the amount of heat generated by the heater or engine 34 in order to match that required to maintain the target temperature at the output of the gas expander, and as measured by temperature sensor T2. Sensor T1 may be omitted if it is placed upstream of the heat exchanger 20, but is usefully included if it is placed downstream in order to provide an indication that the heat exchanger 20 and hence valve V1 and heat exchanger 24 and the associated pump therein, is working correctly. Sensor T2 defines a temperature regulation location at which the control system strives to achieve a target temperature. The controller 30 may be an adaptive controller which includes a learning engine (such as a neural network) which learns the pattern of gas flow that occurs over a daily or weekly cycle. Additionally or alternatively the controller may receive data representing gas flow rates or expected gas flow rates such that the controller can set the pressure reduction station to a state suitable for a forthcoming gas flow rate—thereby stopping, for example, the temperature from falling below a target temperature when a predictable increase in gas flow occurs.

Advantageously the turbo expander 6 is used as the primary pressure reducing device. It can therefore drive a generator 10 whose output may be passed through a switching unit and/or power controller 50. The power controller can supply electricity directly to an electrical output 52 which may supply local devices or alternatively which may represent a connection to the national grid. Additionally the switching unit and power controller 50 may supply electricity to a rectifier 54 which in turn provides a DC supply to an electrolysis unit 56. The electrolysis unit receives a regulated supply of water from a water supply 58 and in turn generates hydrogen and oxygen which are supplied to a hydrogen store 60 and an oxygen store 62, respectively. The hydrogen may be stored in the store 60 for subsequent delivery via a valve V6 to a hydrogen fuel output 64, hydrogen may be used as a fuel for example, for motor vehicles as the waste product of its combustion is merely water and hence it is non-polluting at the point of use. Hydrogen in the store 60 may also be directed by way of a control valve V5 towards a fuel cell 66 which can be used to generate electricity.

The electrolysis unit 56 and the fuel cell 66 each generate heat whilst in use and their temperatures are measured by temperature sensors T3 and T4, respectively, which act as inputs to the controller 30. Each of the electrolysis units and the fuel cell is in thermal contact with a heat exchanger 70 and 72, respectively, which can extract heat from the electrolysis unit 56 and the fuel cell 66 and supply that heat to the central heat exchanger 24. In order to control the rate of extraction, electrically controllable valves V3 and V4 operable under control of the controller 30 are provided in order to ensure that the temperature of the electrolysis unit 36 and the temperature of the fuel cell 66 are maintained within acceptable ranges, that is not too hot and not too cold.

Oxygen in the oxygen store 62 may be provided to a further burner 80 which may burn any suitable fuel, but advantageously bio-fuel, in order to generate heat which in turn may be collected by a further heat exchanger 82 and provided to the central heat exchanger 24 by way of controllable valve V7 in order to provide heat for heating the gas in the vicinity of the expansion devices 4 and 6. Additionally or alternatively heat from the burner 80 may be used for heating the buildings and/or generation of steam as part of an industrial manufacturing process or for the generation of electricity. The burner may include the facility to use hydrogen peroxide as a "flameless" fuel in the production of heat, which is collected by heat exchanger 82.

Electrolysis units, such as 56, typically comprise an anode and a cathode separated by a physical barrier, such as a porous diaphragm of asbestos, or a micro-porous separator of PTFE or the like. Alternatively an aqueous electrolyte containing a small amount of an ionically conducting acid or base may be used. Electrolysis units are commercially available and need not be described further. Similarly fuel cells are commercially available for example from FUEL CELL ENERGY of the USA and hence also need not be described in detail.

As a further refinement to the invention, hygroscopic antifreeze may be injected into the supply main 2 via an injection unit (not shown) and subsequently recovered following the gas expansion.

The controller 30 advantageously controls each of the valves V1 to V8.

It is permissible to allow the gas exiting the expansion devices, i.e. value 4 or turbo expander 6, to drop below 0° C. This can be advantageous where cooling power is required by another process—such as ice making, cold storage, a desiccation process or even just air conditioning.

An additional heat exchanger 92 may be provided in thermal contact with the gas downstream of the expanders 4 and 6 so as to be cooled, thereby providing cooling power for the other process, and consequently to raise the temperature of the gas.

The heat exchanger 92 receives a fluid from the heat exchanger 94 housed within, for example, an ice-making plant 90 which includes a pump (not shown) in order to ensure that a sufficient amount of fluid circulation occurs within the heat exchanger path. Thus the fluid leaving the heat exchanger will advantageously have been cooled to below 0° C., although this is not a necessary condition as further cooling may be performed by a refrigeration plant.

Electrically or electro-pneumatically operated control valve V9 is operable under the control of controller 30 so as to set the flow rate through heat exchanger 92. The controller 30 also controls the rate of ice production by ice-making plant 90 that raises the temperature of the fluid previously cooled a heat exchanger 92 and provided along an input path to heat exchanger 94.

This additional heat exchanger 92 may be in addition to all of the other components described hereinbefore, or may be in place of some of them or indeed all of them if the heat generated by the ice making plant or additional process is sufficient to provide all of the heating required to warm the expanded gas to a desired temperature.

The controller 30 can be arranged to operate the heat sources, such as the bio-diesel fuelled engine 34, fuel cell 66 and supplementary burners or additional engines such that the heat generated by these sources exceeds the heat load required to warm the gas entering the gas pressure reducer to a target value or, alternatively, to control the temperature of the gas leaving to a target value.

The controller can then control the heat delivered to the gas by controlling the flow rate of heat carrying fluid to the heat exchanger 20. However, in such a system the excess heat needs to be removed. An arrangement for doing this is shown in FIG. 2. FIG. 2 shows only a few of the components from FIG. 1 for simplicity and clarity but any of the other components from FIG. 1 are optionally included within the arrangement shown in FIG. 2.

Because more heat is produced by the engine 34 and the devices (not shown) connected to the central heat exchanger 24, then some heat must be diverted to a further heat exchanger 100 via a further control valve V10. Additionally, the internal combustion engine 34 may, if desired, have its coolant path placed in parallel with the output of the central heat exchanger 24 and the fluid flows from these devices may be blended by a blending valve 110 under control of the controller 30.

This can allow heat to be delivered more quickly from the internal combustion engine 34 to the heat exchanger 20 under start up conditions.

The heat exchanger 100 may deliver heat to buildings for space heating or water heating, to swimming pools or to green houses or a combination of these uses. Thus some of these uses may be considered as forming a heat dump or a heat sink. However, items such as swimming pools or even the ground could be used as a heat store (possibly in combination with a heat pump to provide for heat recovery) such that peaks in the gas expansion requirements can be met by delivering heat from the engine/heater and retrieving heat from the heat store.

In some embodiments where an electrolysis plant is provided, the oxygen produced as part of the electrolysis process may be returned to the engine or burner in order to modify its operation. In particular, oxygen may be used to enrich the air supply to the internal combustion engine (or may be used in a post engine secondary burner process) to reduce or modify the pollutants within the exhaust gas or increase the efficiency of the engine.

Multiple engines may be provided such that the heat output from the engines may be controlled by selecting the number of engines that are operating at a given time. The engine or engines can be used to drive generators. These can be used to supply electricity to consumers or businesses. Similarly the $CO_2$ enriched exhaust from the engines may be ducted to greenhouses or the like where the $CO_2$ enhances the growth of plants.

It is thus possible to provide a gas pressure reducer which controls the formation of ice and hydrates within the producing station, and which may also be used to generate electrical energy and/or hydrogen for later use.

By choosing to use bio-fuels, such as bio-diesel, wood, woodchips or the like the station is carbon neutral and hence has a low environmental impact.

By utilising a heater or engine for generating heat which has a fuel which has not derived from the gas supply itself, issues concerning safety or reliability of extracting high pressure gas are avoided and similarly a heating capability is provided so as to warm the components of the gas reduction station prior to resumption of a gas supply if the gas supply had to be interrupted. This avoids the formation of ice or deposits within the pipe during transistory phases such as start up.

The invention claimed is:

1. A gas pressure reducer for reducing gas pressure in a gas distribution system, the gas pressure reducer comprising:

at least one gas expansion device for receiving natural gas and for allowing the gas to expand and thereby, reduce in pressure;

at least one heat exchanger for raising the temperature of the gas in the vicinity of the gas expansion device;

a diesel or bio-fuelled internal combustion engine;

a liquid distribution network for receiving heat from the internal combustion engine and delivering warmed liquid to the at least one heat exchanger;

a temperature sensor monitoring the temperature of gas exiting the gas pressure reducer; and a controller responsive to the temperature sensor for controlling heat it generates so as to vary the heat provided to the at least one heat exchanger from the internal combustion engine.

2. A gas pressure reducer as claimed in claim 1, wherein a heat exchanger is provided downstream of the gas expansion device such that an exchange medium in the heat exchanger is cooled.

3. A gas pressure reducer is claimed in claim 2, where the exchange medium is cooled to below 0° C.

4. A gas pressure reducer as claimed in claim 2, where the exchange medium is provided to a process where cooling is required.

5. A gas pressure reducer as claimed in claim 1, in combination with an ice making facility or a cold store.

6. A gas pressure reducer as claimed in claim 1, wherein the gas expansion device drives a generator for generating electricity.

7. A gas pressure reducer as claimed in claim 6, wherein the electricity generated by the generator is provided to an electrolysis unit wherein water is converted into hydrogen and oxygen, and heat is produced.

8. A gas pressure reducer as claimed in claim 7, wherein the oxygen produced in the electrolysis unit is provided to a burner for the production of heat, or to the liquid fuelled engine.

9. A gas pressure reducer as claimed in claim 7, wherein the hydrogen produced in the electrolysis unit is provided to a fuel cell wherein electricity is generated and heat is produced.

10. A gas pressure reducer as claimed in claim 6, wherein the gas pressure reduces further comprises:

at least one valve (V1 to V9) for regulating the heat supplied to the gas, wherein the controller controls the or each valve (V1 to V9) so as to control the heat supplied to the gas to achieve a target gas temperature.

11. A gas pressure reducer as claimed in claim 1, wherein the device for raising the temperature of the gas is, in use, arranged to supply an excess of energy compared to that required to raise the gas to a target temperature, and wherein a further heat exchanger is provided and a controller acts to divert excess heat towards the further heat exchanger.

12. A gas pressure reducer as claimed in claim 1, in which the internal combustion engine runs on crop derived fuel.

13. A gas pressure reducer as claimed in claim 1, in which the internal combustion engine runs on bio-diesel or bio-fuel.

14. A gas pressure reducer as claimed in claim 11, in which the further heat exchanger delivers the excess heat to a heat dump, a heat sink or a heat store.

15. A gas pressure reducer as claimed in claim 1, in which exhaust from the internal combustion engine is delivered to a plant growing area to enrich the carbon dioxide available to the plants.

* * * * *